United States Patent [19]

Benai et al.

[11] 4,371,491

[45] Feb. 1, 1983

[54] PROCESS FOR THE CONTINUOUS SPINNING OF VISCOSE RAYON

[75] Inventors: Tommaso Benai, Rieti; Novello Leoncini, Limbiate; Ugo Paoletti, Monza, all of Italy

[73] Assignee: Snia Viscosa Societa' Nazionale Industria Applicazioni Viscosa S.p.A., Milan, Italy

[21] Appl. No.: 223,926

[22] Filed: Jan. 9, 1981

[30] Foreign Application Priority Data

Jan. 9, 1980 [IT] Italy ..... 19109 A/80

[51] Int. Cl.[3] ..... D01F 2/06

[52] U.S. Cl. ..... 264/196; 8/137.5

[58] Field of Search ..... 264/188, 196; 8/137.5

[56] References Cited

U.S. PATENT DOCUMENTS

| | | | |
|---|---|---|---|
| 2,307,863 | 1/1943 | Soukup | 264/196 |
| 2,309,072 | 1/1943 | Burkholder | 8/137.5 |
| 2,416,533 | 2/1947 | Naumann | 264/196 |
| 2,974,363 | 3/1961 | Meyer | 425/66 |
| 3,741,862 | 6/1973 | Kubota et al. | 9/197 |

FOREIGN PATENT DOCUMENTS

| | | | |
|---|---|---|---|
| 516303 | 2/1955 | Italy | 425/66 |

*Primary Examiner*—Jay H. Woo

*Attorney, Agent, or Firm*—Wenderoth, Lind & Ponack

[57] ABSTRACT

A process is described for the continuous spinning of viscose rayon. Said process is characterized by the fact that after the coagulation and drawing of the yarn, a two-stage setting is carried out, the first stage being at higher temperature and acidity than the second stage. The two-stage setting permits one to obtain a yarn which is not only perfectly set but is also substantially desulphurated and the classic desulphuration operation is thus eliminated. The setting is followed by at least one washing and by the other conventional treatments, with the exception of the desulphuration. The viscose rayon continuous spinning process is carried out while the yarn travels in a substantially helical path.

4 Claims, 2 Drawing Figures

PROCESS FOR THE CONTINUOUS SPINNING OF VISCOSE RAYON

BACKGROUND OF THE INVENTION

The present invention relates to an improvement in viscose rayon continuous spinning processes.

Viscose rayon continuous spinning processes are known, in which the viscose, extruded from suitable spinnerets into a coagulating bath, undergoes coagulation and drawing in said bath or in successive baths, and thereafter is conveyed to a support and advancing apparatus which causes it to travel in an essentially helical path, viz. a path which is constituted by a series of successive coils whose configuration is not exactly helical but is close to it; the yarn undergoing a series of treatments, while it travels in said path, until it reaches the desired final characteristics. A type of apparatus adapted to impart to the coagulated and drawn yarn a substantially helical path, and to which reference will be made hereinafter, is constituted by a main roller, having a relatively large diameter, and by a series of secondary rollers having much smaller diameters, and having axes which are askew with respect to that of the first one. The secondary rollers are normally called advancing rollers. The main roller is also called the treatment roller because the chemical and thermal treatments occur thereon. Since in devices of this kind, one yarn corresponds to each advancing roller, viz. a plurality of yarns concurrently travel in the apparatus, all the yarns engaging the treatment roller and each yarn separately engaging a distinct advancing roller, reference will be made in describing the present invention to an apparatus having a single advancing roller, and therefore the invention will be described with reference to a single yarn: it being understood, however, that when the invention is carried into practice, a plurality of yarns will generally be treated concurrently and consequently the advancing rollers will be more than one.

The main or treatment roller, and consequently the substantially helical path of the yarn, is divided into several successive zones in the direction of travel of the yarn, or in the longitudinal direction of the treatment roller, a distinct treatment phase corresponding to each of said zones. Said various zones are normally separated by suitable, e.g. mechanical, means, and a very simple separation method consists in providing flanges or pairs of flanges interposed between each zone and those adjacent to it. In describing the invention, reference will be made to a device of this kind, it being understood, however, that the invention is independent of the particular mechanical means with which it is carried into practice.

According to the conventional technique heretofore employed, after the coagulation and drawing of the yarn, a setting by means an acid bath takes place, which is followed in general by a wash, which is followed by desulphuration and generally by a bleaching and finishing treatment, all followed by washes, and finally the yarn is dried.

SUMMARY OF THE INVENTION

It has been surprisingly found that if a two-stage setting is carried out after the coagulation and drawing of the yarn, in place of the traditional setting, the first stage taking place at a higher temperature and acidity and the second at a lower temperature and acidity, a yarn is obtained which not only is perfectly set, but is also substantially desulphurated. Inasmuch as the sulphurous salts which the yarn contains are eliminated and only a small amount of elementary sulphur remains in the fibre, the influence of the sulphur on the quality of the yarn is negligible.

Preferably, the solutions used for the two aforesaid settings are aqueous solutions of $H_2SO_4$, $Na_2SO_4$ and $ZnSO_4$, and the preferred processing conditions are:

for the first setting: from 30 to 70 gr/lt of $H_2SO_4$, from 60 to 140 gr/lt of $Na_2SO_4$, from 1.8 to 4.2 gr/lt of $ZnSO_4$, and temperatures from 65° C. to 85° C.; for the second setting: from 15 to 35 gr/lt of $H_2SO_4$, from 30 to 70 gr/lt of $Na_2SO_4$, from 0.9 to 2.1 gr/lt of $ZnSO_4$, and temperatures from 50° C. to 70° C.

The possibility of eliminating the classic desulphuration operation provides a considerable technical progress since, first of all the sulphide bath is eliminated, which bath is particularly aggressive (and therefore requires the use of special materials) and is harmful from a pollution viewpoint. Further, as will more clearly appear hereinafter, it becomes possible to eliminate one procesing zone, whereby the space take-up of the treatment roller is reduced, the spinning speed remaining the same—or possibly, said speed is increased, and the space take-up of the treatment roller remains the same.

DETAILED DESCRIPTION OF THE PREFERRED EMBODIMENTS

In one embodiment of the invention, said setting treatment is followed by a washing with water at a temperature of about 30° C., which has the effect of eliminating the residual acidity of the yarn and the soluble salts. In another embodiment, two washings are carried out under the said conditions, and in that case the normal number of treatment zones must be provided.

In any case, the physical and chemical characteristics of the yarn perfectly satisfactory, as will appear from the following examples.

The invention may be applied independently of the way in which the coagulation and drawing of the yarn is effected. In particular, said operations may be carried out in the traditional way; and further, the apparatus which is also used for the treatments which follow the setting, may be of a known type, such as described e.g. in the previous Italian patents of the same Applicant, Nos. 516.501 and 535.752.

Figure 2:
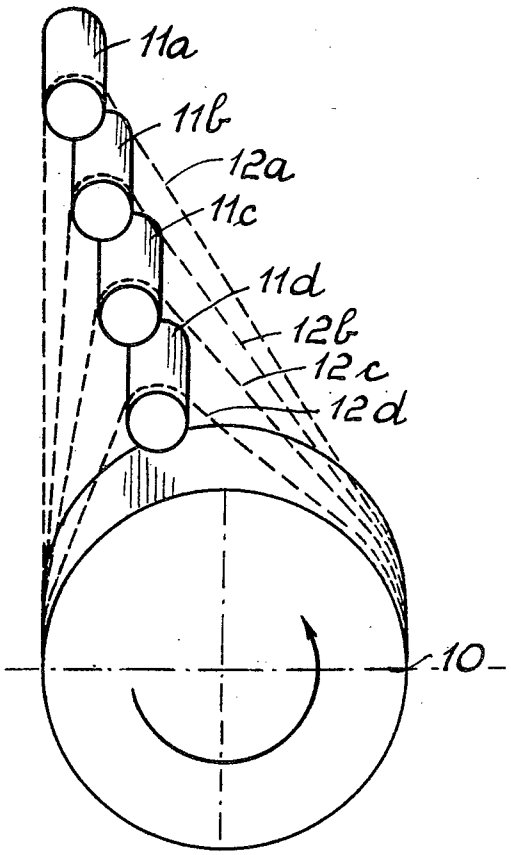
Figure 1:
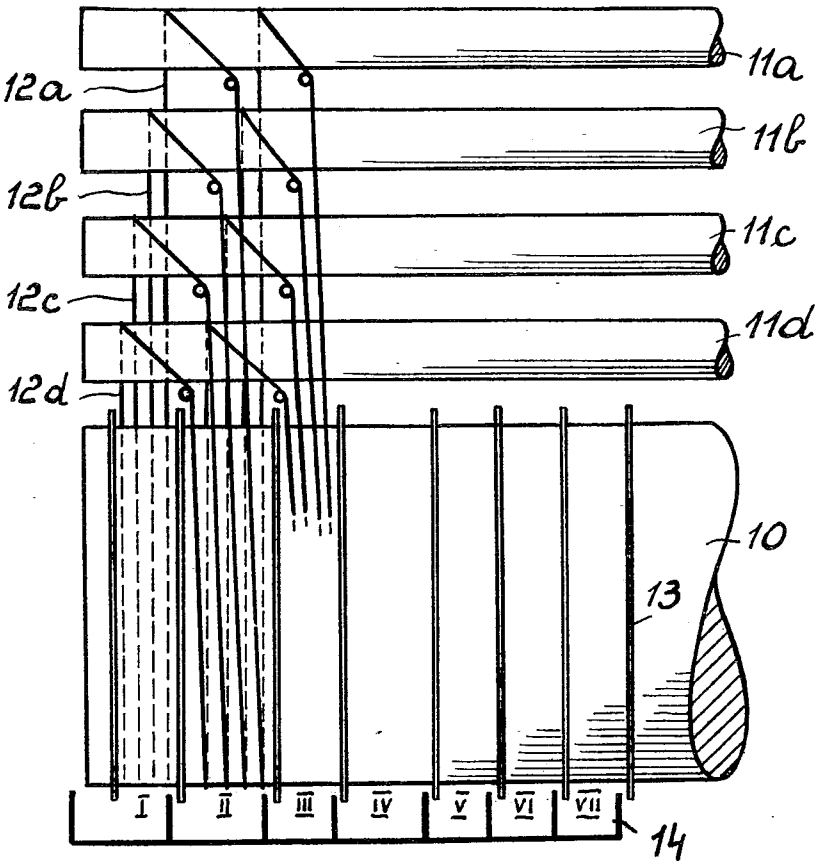

The invention will be better understood from the description of some non-limitative examples, with reference to the attached drawings which schematically illustrate an askew rollers device for the advancing and treatment of the yarn, such as described in the cited Italian Pat. No. 516.501, wherein:

FIG. 1 illustrates in schematical lateral view said device, which comprises four advancing rollers for the concurrent treatment of four yarns; and FIG. 2 illustrates the same device in schematic end view.

In the figures, the treatment and advancing rollers are illustrated as broken off, only seven treatment zones being shown, which are as many as are considered in the examples which will follow. The drying zone is not illustrated, since it is not related to the invention, but it will normally exist, and other zones could be added for purposes which are not related to the invention.

In the drawings, 10 indicates the treatment roller, and 11*a*, 11*b*, 11*c* and 11*d* the advancing rollers, which, as has been said, are positioned askew with respect to the treatment roller. 12*a*, 12*b*, 12*c* and 12*d* are the yarns, only partially illustrated. 13 are the separation flanges of the several zones from one another, which could be pairs or could be of any type. The means for feeding the treatment liquors are omitted for the sake of simplicity. 14 is the tub for collecting the liquors, which is provided with discharge outlets not illustrated. The various treatment zones are indicated by roman numerals from I to VII, corresponding to the numbers by which the respective treatments will be designated in the following table.

In all the examples which follow, a yarn having a count of 120 deniers has been spun at the speed of 110 meters per minute, corresponding to a production of 0.352 kg per roller and per hour. The first two examples are comparison examples, Example 1 referring to a spinning without desulphuration and Example 2 to a spinning with conventional desulphuration by means of an $Na_2S$ bath. The third example illustrates the invention.

The data relative to the three examples are tabulated in the following table, in which each column corresponds to a treatment zone and therefore to a treatment, and each line to an example, except for the last two lines which define the periods of time in which the yarn remains in each zone, viz. the duration of each treatment, and the flow rates of the baths by volume. It is to be noted tha a further zone could be added to the zones listed, for optionally effecting an additional treatment, but such a possibility has not been considered either in the examples or in the figures in order to avoid useless complication.

| Roller Zones | I | II | III | IV | V | VI | VII |
|---|---|---|---|---|---|---|---|
| Example 1 | $H_2SO_4$ gr/lt 25<br>$Na_2SO_4$ gr/lt 50<br>$ZnSO_4$ gr/lt 1.5<br>T °C. 76 | $H_2O$<br>T °C. 30 | $H_2O$<br>T °C. 30 | $H_2O$<br>T °C. 30 | Bleach:<br>NaOCl gr/lt 1.2<br>pH 9<br>T °C. 30 | $H_2O$<br>T °C. 30 | Finishing:<br>fats gr/lt 3<br>pH 8.3<br>T °C. 40 |
| Example 2 | $H_2SO_4$ gr/lt 25<br>$Na_2SO_4$ gr/lt 50<br>$ZnSO_4$ gr/lt 1.5<br>T °C. 76 | $H_2O$<br>T °C. 30 | $Na_2S$ gr/lt 4<br>NaOH gr/lt 1.5<br>T °C. 62 | $H_2O$<br>T °C. 30 | NaOCl gr/lt 1.2<br>pH 9<br>T °C. 30 | $H_2O$<br>T °C. 30 | fats gr/lt 3<br>pH 8.3<br>T °C. 40 |
| Example 3 | $H_2SO_4$ gr/lt 50<br>$Na_2SO_4$ gr/lt 100<br>$ZnSO_4$ gr/lt 3<br>T °C. 76 | $H_2SO_4$ gr/lt 25<br>$Na_2SO_4$ gr/lt 50<br>$ZnSO_4$ gr/lt 1.5<br>T °C. 62 | $H_2O$<br>T °C. 30 | $H_2O$<br>T °C. 30 | NaOCl gr/lt 1.2<br>pH 9<br>T °C. 30 | $H_2O$<br>T °C. 30 | fats gr/lt 3<br>pH 8.3<br>T °C. 40 |
| Duration of treatment | 11 | 11 | 18 | 11 | 11 | 11 | 9 |
| Liquor flow rate lt/kg of fibre | 300 | 300 | 300 | 300 | 300 | 300 | 150 |

The yarns obtained by operating according to the three examples have been subjected to the determination of their textile characteristics, which appear to be practically unvaried in the three cases and which are: Tenacity in the conditioned state: 1.83–1.86 gr/den Tenacity in the wet state: 0.84–0.88 gr/den Elongation in the conditioned state: 16–19% Elongation in the wet state: 30–32%

The chemical analysis of the fibres has furnished the following results:

Example 1:
free S 0.12%
ZnS 0.02%

Example 2:
free S 0.06%
ZnS 0.025%

Example 3:
free S 0.08%
ZnS 0.01%

It is obvious that the application of the invention, while it has made it possible to eliminate the $Na_2S$ bath, has not negatively influenced the quality of the yarn, which on the other hand the invention method is superior to that which would have been obtained by the mere elimination of the desulphuration in the tradiational process.

If the zone III and the respective wash is eliminated in Example 3, the space take-up of the spinning machine may be reduced, or the speed may be increased while the space take-up remains the same, and the physical and chemical characteristics of the fibre will be unvaried with respect to Example 3. Such an example therefore is not tabulated in the table, since it may be directly deduced from Example 3 by the mere elimination of treatment III.

We claims:

1. In a process for the continuous spinning of viscose rayon comprising continuously carrying out the steps of: coagulating and drawing the rayon yarn, and setting the yarn, the improvement which consists essentially of subjecting the yarn to a first setting treatment at 65° to 85° C. with a first aqueous bath containing from 30 to 70 g/l of $H_2SO_4$, 60 to 140 g/l of $Na_2SO_4$ and from 1.8 to 4.2 g/l of $ZnSO_4$; thereafter subjecting the yarn to a second setting treatment at 50° to 70° C. with a second aqueous bath containing from 15 to 35 g/l of $H_2SO_4$, 30 to 70 g/l of $Na_2SO_4$ and from 0.9 to 2.1 g/l of $ZnSO_4$, and washing the yarn, all of said steps being carried out continuously said second setting treatment being at a lower temperature and acidity than the first setting treatment such that the sulphurous salts in the yarn are substantially eliminated by the combined first and second setting treatments.

2. A process according to claim 1, wherein the setting and washing steps are carried out while the yarn travels in a substantially helical path.

3. A process according to any of claims 1 or 2 wherein the yarn is washed with water at a temperature of 30° C.

4. A process according to claim 3 wherein two washing steps are applied to the yarn.

* * * * *